US009263785B2

(12) United States Patent
Ligander et al.

(10) Patent No.: US 9,263,785 B2
(45) Date of Patent: Feb. 16, 2016

(54) ELECTRICALLY TUNABLE WAVEGUIDE FILTER AND WAVEGUIDE TUNING DEVICE

(75) Inventors: Per Ligander, Gothenburg (SE); Simone Bastioli, Rutherford, NJ (US); Luca Pelliccia, Foligno (IT); Ove Persson, Hunnebostrand (SE); Roberto Sorrentino, Perugia (IT)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 358 days.

(21) Appl. No.: 13/813,499

(22) PCT Filed: Aug. 2, 2010

(86) PCT No.: PCT/EP2010/061218
§ 371 (c)(1),
(2), (4) Date: Jan. 31, 2013

(87) PCT Pub. No.: WO2012/016584
PCT Pub. Date: Feb. 9, 2012

(65) Prior Publication Data

US 2013/0135064 A1 May 30, 2013

(51) Int. Cl.

| | |
|---|---|
| ***H01P 3/12*** | (2006.01) |
| ***H01P 1/10*** | (2006.01) |
| ***H01P 1/201*** | (2006.01) |
| ***H01P 1/207*** | (2006.01) |

(52) U.S. Cl.
CPC .. *H01P 3/12* (2013.01); *H01P 1/10* (2013.01); *H01P 1/207* (2013.01); *H01P 1/2016* (2013.01)

(58) Field of Classification Search
CPC ..... H01P 1/207–1/208; H01P 3/12; H01P 3/023; H01P 1/10
USPC ..... 333/209, 239, 248, 262
See application file for complete search history.

(56) References Cited

U.S. PATENT DOCUMENTS

| | | | |
|---|---|---|---|
| 5,808,528 | A | 9/1998 | Griffith et al. |
| 7,456,711 | B1 | 11/2008 | Goldsmith |
| 2005/0270125 | A1 | 12/2005 | Higgins et al. |
| 2011/0084783 | A1 | 4/2011 | Jinnai |

FOREIGN PATENT DOCUMENTS

| | | | |
|---|---|---|---|
| WO | 2009157494 | A1 | 12/2009 |
| WO | 2010063307 | A1 | 6/2010 |

OTHER PUBLICATIONS

Park, S. et al, "High-Q RF-MEMS Tunable Evanescent-Mode Cavity Filter", 2009, IEEE, Microwave Symposium Digest, p. 1145-1148.*

* cited by examiner

*Primary Examiner* — Benny Lee
*Assistant Examiner* — Albens Dieujuste
(74) *Attorney, Agent, or Firm* — Rothwell, Figg, Ernst & Manbeck, P.C.

(57) ABSTRACT

The present invention relates to a waveguide tuning device (1) arranged for mounting in a waveguide structure (2) which has a longitudinal extension (L) and comprises a first inner wall (3), a second inner wall (4), a third inner wall (5) and a fourth inner wall. The inner walls are arranged such that a rectangular cross-section is obtained for the waveguide structure. The first inner wall (3) and the second inner wall (4) have a first length (b) and are facing each other. The third inner wall (5) and the fourth inner wall (6) have a second length (a) and are facing each other. The electrical field (E) is parallel to the main surfaces of the first inner wall (3) and the second inner wall (4). The tuning device (1) is electrically controllable and arranged for mounting at the first inner wall (3) and/or the second inner wall (4). The present invention also relates to a tunable waveguide structure.

13 Claims, 6 Drawing Sheets

ELECTRICALLY TUNABLE WAVEGUIDE FILTER AND WAVEGUIDE TUNING DEVICE

CROSS-REFERENCE TO RELATED APPLICATION

This application is a 35 U.S.C. §371 National Phase Entry Application from PCT/EP2010/061218, filed Aug. 2, 2010, and designating the United States.

TECHNICAL FIELD

The present invention relates to a waveguide tuning device arranged for mounting in a waveguide structure which has a longitudinal extension and comprises a first inner wall, a second inner wall, a third inner wall and a fourth inner wall. The inner walls are constituted by respective main surfaces and are electrically conducting, and are arranged such that a rectangular cross-section is obtained for the waveguide structure. The first inner wall and the second inner wall have a first length and are facing each other. The third inner wall and the fourth inner wall have a second length and are facing each other. The electrical field is parallel to the main surfaces of the first inner wall and the second inner wall.

The present invention also relates to a tunable waveguide structure having a longitudinal extension and comprises a first inner wall, a second inner wall, a third inner wall and a fourth inner wall. The inner walls are constituted by respective main surfaces and are electrically conducting, and are arranged such that a rectangular cross-section is obtained for the waveguide structure. The first inner wall and the second inner wall have a first length and are facing each other. The third inner wall and the fourth inner wall have a second length and are facing each other. The electrical field is parallel to the main surfaces of the first inner wall and the second inner wall.

BACKGROUND

Electrical tuning of waveguide filters for radio communication is a well known technology. The usual way to implement electrical tuning devices in a waveguide is to vary the capacitive and inductive coupling in the waveguide and also to design additional structures in the waveguide to concentrate the electric field to the position where the tuning device is placed.

However, tuning of waveguide filters and other waveguide structures using pin diodes, ferroelectrics and MEMS in this way will affect the general electrical performance of the waveguide filter in a negative way. One of the absolute major problems is the resulting low effective Q-factor when for example using pin diodes or ferroelectric structures in a waveguide filter, which in turn results in high losses. MEMS-structures have also been used for tuning such filters, with the same poor result as for pin diodes and ferroelectric structures.

There is thus a need for an enhanced waveguide tuning device that is electrically controllable and an enhanced electrically tunable waveguide structure.

SUMMARY

The object of the present invention is to provide an enhanced waveguide tuning device that is electrically controllable and an enhanced electrically tunable waveguide structure.

This object is achieved by means of a waveguide tuning device arranged for mounting in a waveguide structure which has a longitudinal extension and comprises a first inner wall, a second inner wall, a third inner wall and a fourth inner wall. The inner walls are constituted by respective main surfaces and are electrically conducting, and are arranged such that a rectangular cross-section is obtained for the waveguide structure. The first inner wall and the second inner wall have a first length and are facing each other. The third inner wall and the fourth inner wall have a second length and are facing each other. The electrical field is parallel to the main surfaces of the first inner wall and the second inner wall. The tuning device is electrically controllable and arranged for mounting at the first inner wall and/or the second inner wall.

This object is also achieved by means of a tunable waveguide structure which has a longitudinal extension and comprises a first inner wall, a second inner wall, a third inner wall and a fourth inner wall. The inner walls are constituted by respective main surfaces and are electrically conducting, and are arranged such that a rectangular cross-section is obtained for the waveguide structure. The first inner wall and the second inner wall have a first length and are facing each other. The third inner wall and the fourth inner wall have a second length and are facing each other. The electrical field is parallel to the main surfaces of the first inner wall and the second inner wall. At least one electrically controllable tuning device is arranged for mounting at the first inner wall and/or the second inner wall According to an example, the second length exceeds the first length.

According to another example, the tuning device is arranged for altering the second length between at least two values along the extension of the tuning device.

According to another example, the tuning device comprises a non-conducting laminate on which at least one row of switches is placed, the switches being electrically openable and closable and being arranged to constitute an electrically conducting connection between the third inner wall and the fourth inner wall. The switches may be of the type Micro Electro Mechanical Systems, MEMS.

According to another example, the waveguide structure is in the form of a surface-mountable wave-guide part, which is arranged to be mounted to a printed circuit board, PCB, such that a metalization on the PCB constitutes the first inner wall.

According to another example, the waveguide structure comprises a first part and a second part, where the first part comprises the first inner wall, partly the third inner wall and partly the fourth inner wall. Furthermore, the second part comprises the second inner wall, partly the third inner wall and partly the fourth inner wall. The tuning device is arranged to be placed on the first inner wall in order to alter the distance between the first inner wall and the second inner wall. A metal foil with at least two apertures is arranged to be placed between the first part and the second part, then running parallel to the first inner wall and the second inner wall.

Other examples are evident from the dependent claims.

A number of advantages are obtained by means of the present invention, for example:

high Q-factor,
low loss, and
a desired tuning range.

BRIEF DESCRIPTION OF THE DRAWINGS

The present invention will now be described more in detail with reference to the appended drawings, where.

DETAILED DESCRIPTION

Figure 1:
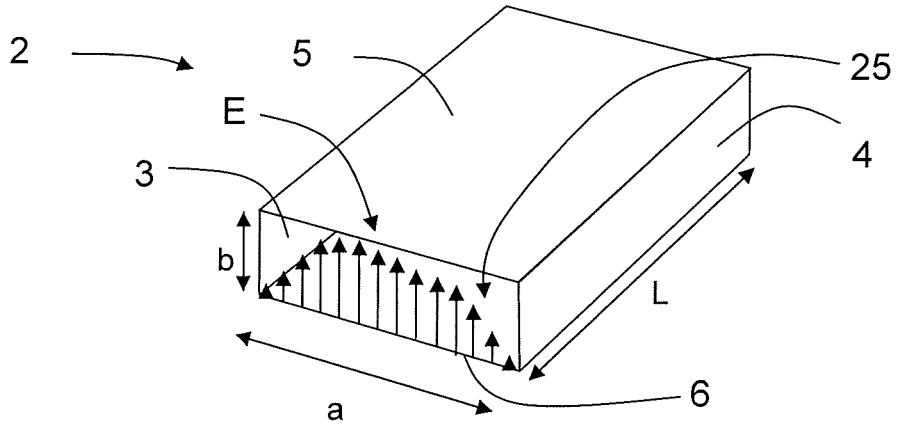
FIG. 1 shows a simplified view of a waveguide, only showing the inner walls.
Figure 2:
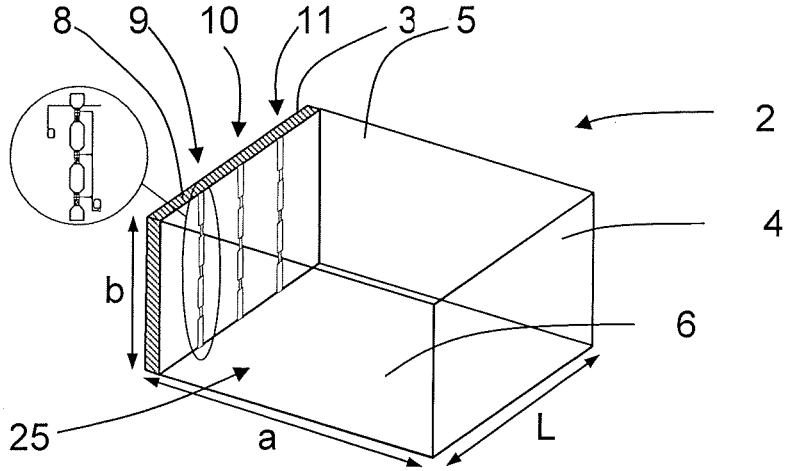
FIG. 2 shows a simplified view of a waveguide with a MEMS structure, only showing the inner walls of the waveguide.

With reference to FIG. 1 and FIG. 2, there is a waveguide structure 2 having a longitudinal extension L and comprising a first inner wall 3, a second inner wall 4, a third inner wall 5 and a fourth inner wall 6. For reasons of clarity, only the inner walls are indicated in FIG. 1 and FIG. 2.

The inner walls 3, 4, 5, 6 are constituted by respective main surfaces and are electrically conducting, the inner walls 3, 4, 5, 6 furthermore being mounted such that a rectangular cross-section comprising an opening 25 is obtained for the waveguide structure 2. The first inner wall 3 and the second inner wall 4 have a first length b in the rectangular cross-section and are facing each other. In a similar way, the third inner wall 5 and the fourth inner wall 6 have a second length a in the rectangular cross-section and are facing each other. The electrical field E is indicated in FIG. 1 and is parallel to the main surfaces of the first inner wall 3 and the second inner wall 4.

Figure 3:
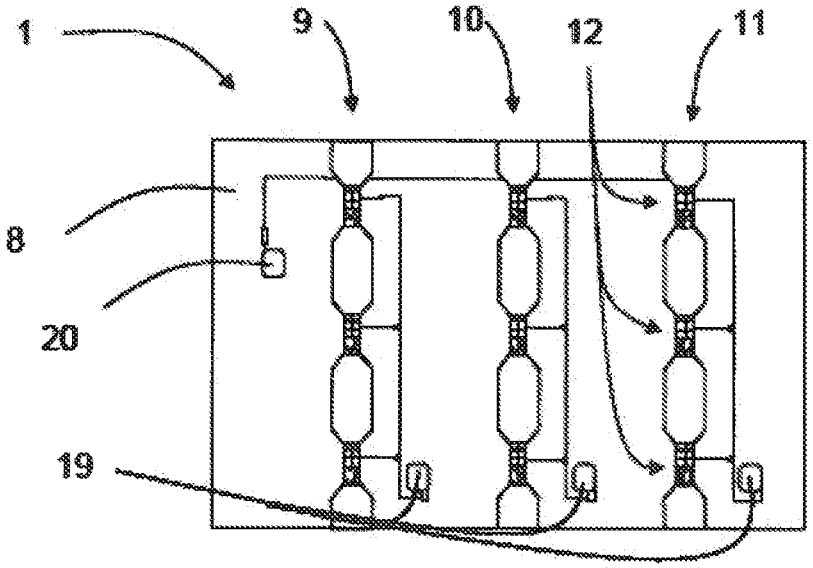
FIG. 3 shows a simplified view of a substrate with a MEMS structure as used in the present invention.

According to the present invention, with reference to FIG. 3, a MEMS (Micro Electro Mechanical Systems) structure 1, based on cantilever switches 12 and positioned on a MEMS substrate 8 which serves as a carrier material, is mounted on the first inner wall 3. A magnification of a part of the MEMS structure 1 is shown in a magnifying circle in FIG. 2.

In FIG. 2 and FIG. 3, one MEMS structure 1 is shown with 3 rows 9, 10, 11 of switches 12. The switches 12 are electrically controlled by means of bias voltages, which are applied at certain bias inputs 19. A common ground pad 20 is used. When no bias voltage is applied, the switches 12 in a corresponding row 9, 10, 11 are open, and when voltage is applied, the switches 12 in a corresponding row 9, 10, 11 will be closed.

Figure 4:
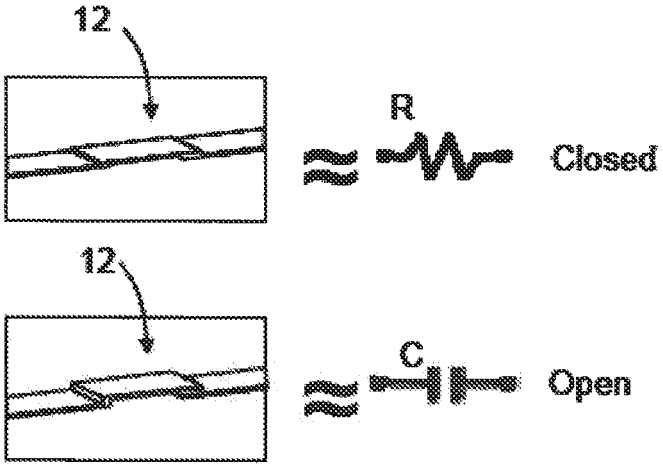
FIG. 4 shows the different states of each switch of a MEMS structure as used in the present invention.

This is illustrated in detail in FIG. 4, where, in a first state where bias voltage is applied, one shown switch 12 is closed, and can be regarded as equivalent to a resistor R. In a second state where no bias voltage is applied, the shown switch 12 is open, and can be regarded as equivalent to a capacitor C.

How the tuning is performed by means of the MEMS structure 1 will now be explained more in detail with reference to FIG. 5 and FIG. 6, where each of these Figures shows a simplified top view, side view and sectional view of a waveguide structure 2.

As shown, there are two MEMS structures 1*a*, 1*b* positioned at both short sides of the waveguide structure 2; a first MEMS structure 1*a* mounted to the first inner wall 3 and a second MEMS structure 1*b* mounted to the inner second inner wall 4. In section A-A in FIG. 5 and FIG. 6, the first MEMS structure 1*a* is shown mounted to the first inner wall 3. The substrate 8 comprises a conducting frame 21 with vias 22. In this way, a good electrical connection between the rows 9, 10, 11 of switches and the surrounding third inner wall 5 and fourth inner wall 6 is ensured.

Figure 5:
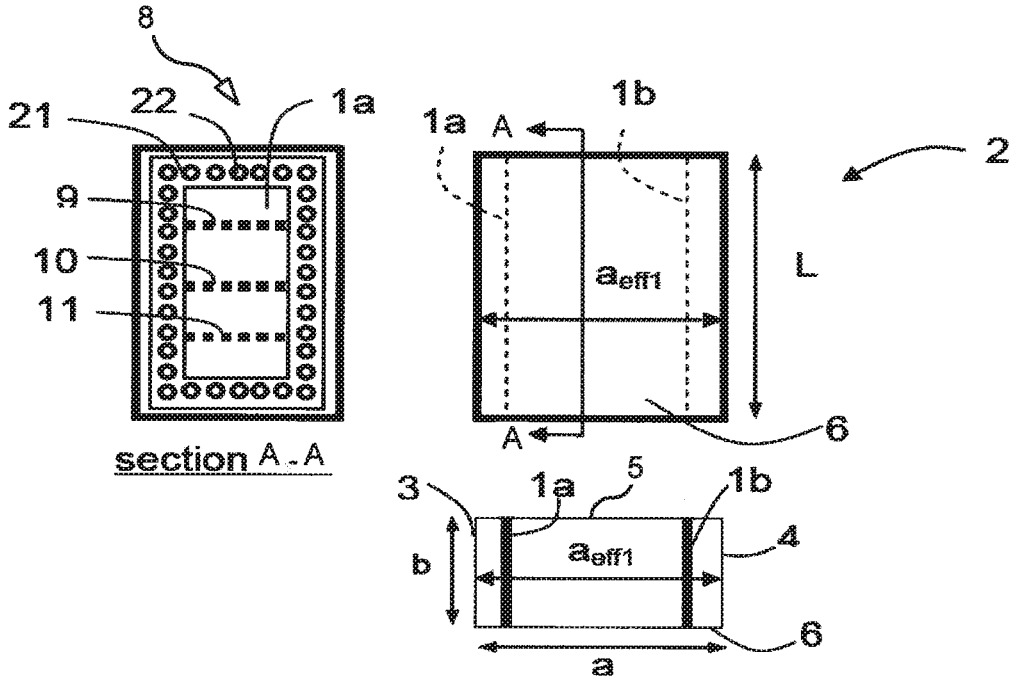
FIG. 5 shows a simplified top view, side view and sectional view of a waveguide with MEMS structures in a first open state.

In FIG. 5, the switches 12 are opened, and in this state the MEMS structures 1*a*, 1*b* do not affect the original electrical dimension of the waveguide structure 2, the second length, a, having an original measure $a_{eff1}$.

Figure 6:
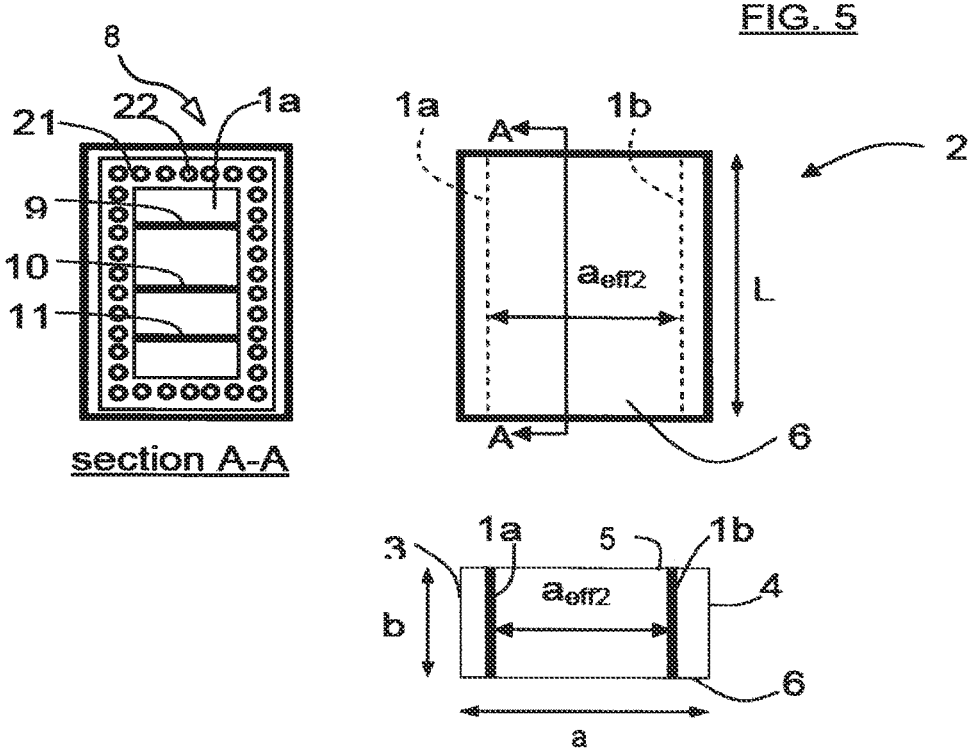
FIG. 6 shows a simplified top view, side view and sectional view of a waveguide with MEMS structures in a second closed state.

In FIG. 6, the switches 12 are closed such that each row 9, 10, 11 constitutes a electrically conducting connection between the third inner wall 5 and the fourth inner wall 6 via the conducting frame 21. In this way, the electrical dimension of the second length, a, is altered from the original measure $a_{eff1}$ to a new measure $a_{eff2}$.

In FIG. 6, the electric dimension of the cavity is not defined only by the metal walls of the waveguide, but also of an artificial wall which primarily is constituted by the rows 9, 10, 11 of closed switches 12 that constitute electrically conducting connections. The artificial walls confine the electric field and make the waveguide electrically smaller which makes the resonance frequency higher than when the switches 12 are opened.

When the switches 12 are opened again, as shown in FIG. 5, the field will be confined by the metal walls of the waveguide structure 2. The waveguide structure 2 will be electrically larger which makes the resonance frequency lower than when the switches 12 are closed.

Two examples of filter structures will be described, first a cavity filter with a surface-mounted waveguide structure 2' and then an E-plane filter.

Figure 7:
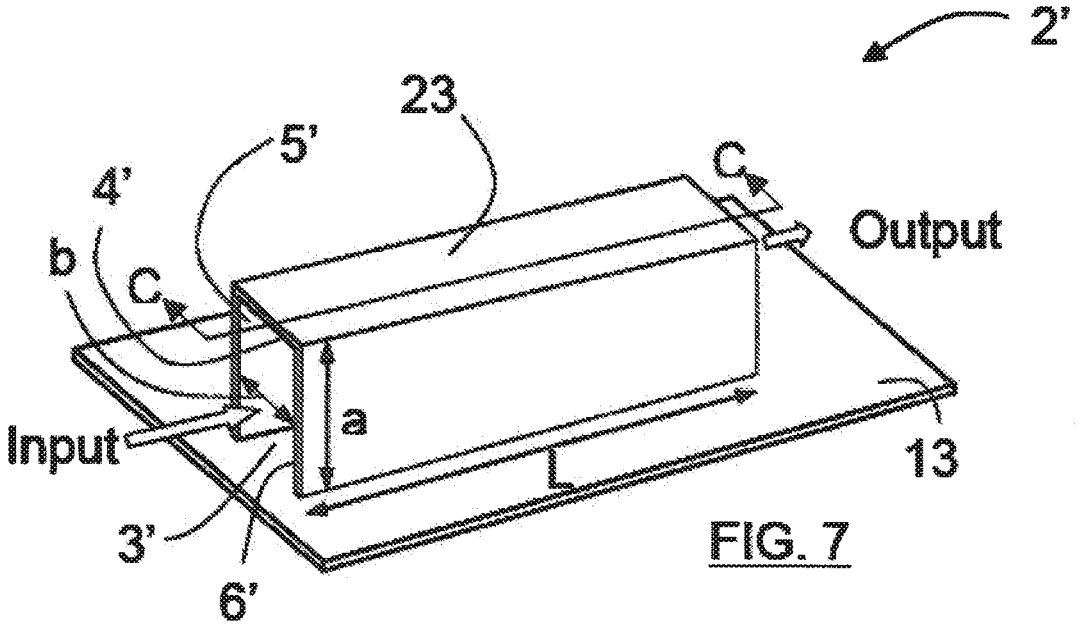
FIG. 7 shows a simplified view of a surface-mounted waveguide used as a cavity filter with the MEMS structure in a first filter example.
Figure 8:
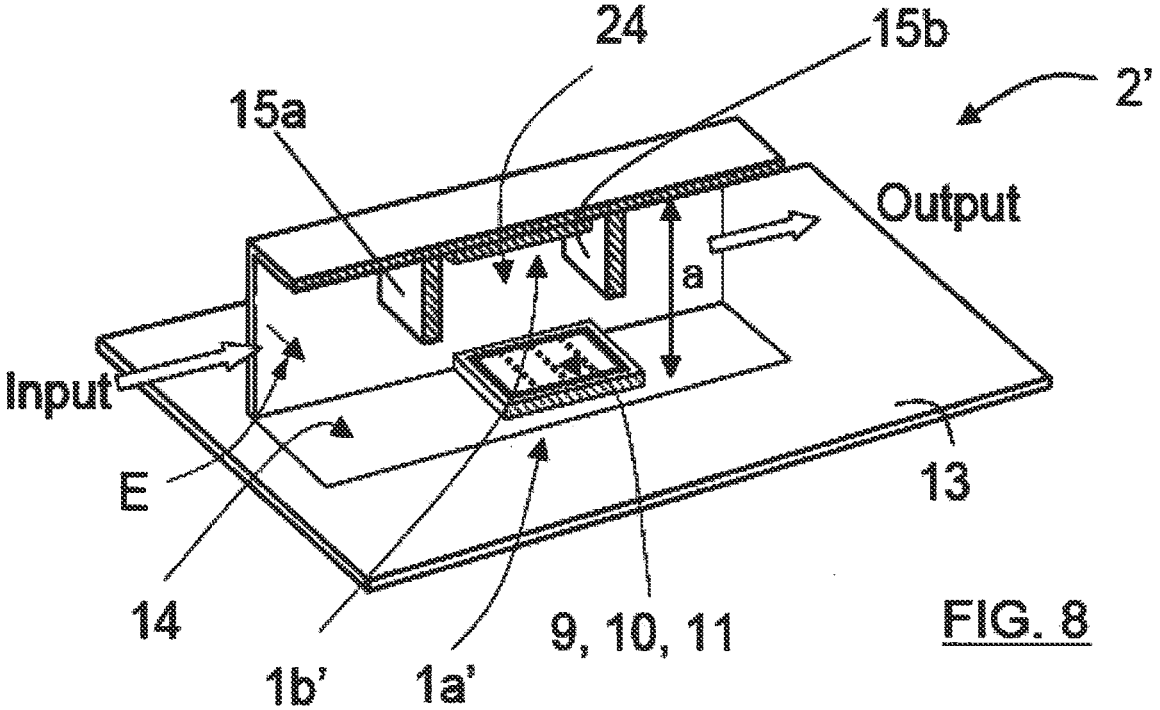
FIG. 8 shows a sectional perspective view of FIG. 7.
Figure 9:
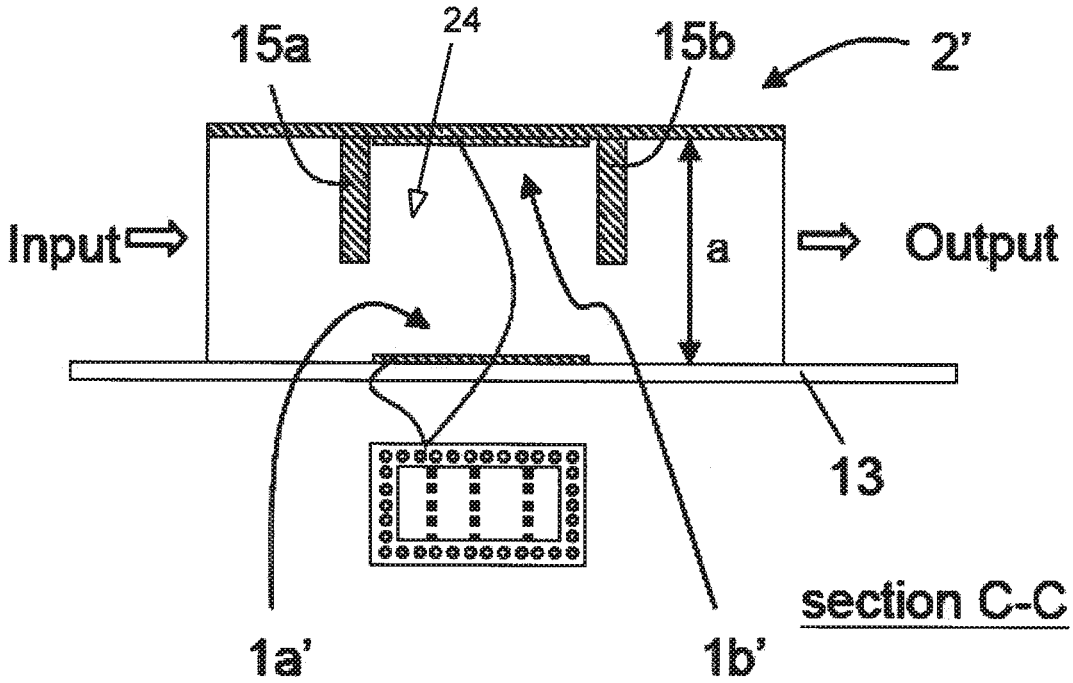
FIG. 9 shows a sectional side view of FIG. 7.

A cavity filter with a surface-mounted waveguide structure 2' will be described with reference to FIG. 7, showing a view of a surface-mounted waveguide used as a cavity filter with the MEMS structure in a first filter example, FIG. 8, showing a sectional perspective view of FIG. 7, and FIG. 9, showing a sectional side view of FIG. 7.

The waveguide structure 2' is in the form of a Surface Mountable Waveguide (SMW) part 23 mounted to a printed circuit board (PCB) 13 such that a metalization 14 on the PCB 13 constitutes the first inner wall 3'. The second inner wall 4', the third inner wall 5' and the fourth inner wall 6' are all formed in the SMW part 23. The SMW part 23 further comprises a first iris 15*a* and a second iris 15*b* placed between the second inner wall 4', the third inner wall 5' and the fourth inner wall 6'. Each iris 15*a*, 15*b* is in the form of a metal wall that has a main extension that runs perpendicular to the main surfaces of the inner walls 3', 4', 5', 6', contacting the second inner wall 4', the third inner wall 5' and the fourth inner wall 6', but not reaching the first inner wall 3'. These are asymmetrical inductive irises 15, 15*b* which define a cavity 24.

In FIG. 7, FIG. 8 and FIG. 9 an input end and an output end for the waveguide structure 2' are indicated with arrows.

A first MEMS structure 1*a'* is placed on the first inner wall 3' and a second MEMS structure 1*b'* is placed on the second inner wall 4', between the irises 15*a*, 15*b*, such that the first MEMS structure 1*a'* and the second MEMS structure 1*b'* face each other. In FIG. 9, a schematic separate top view of the MEMS structures 1*a*', 1*b*' is shown. The cavity 24 is thus located directly above the first MEMS-structure 1*a*'.

The MEMS structures 1*a*', 1*b*' are arranged to alter the distance between the first inner wall 3' and the second inner wall 4' in a corresponding manner as discussed with reference to FIG. 5 and FIG. 6.

Preferably the SMW part 23 and the first MEMS structure 1*a*' are soldered to the PCB and will be biased from the PCB where the bias connection is placed in an internal layer of the PCB.

Figure 10:
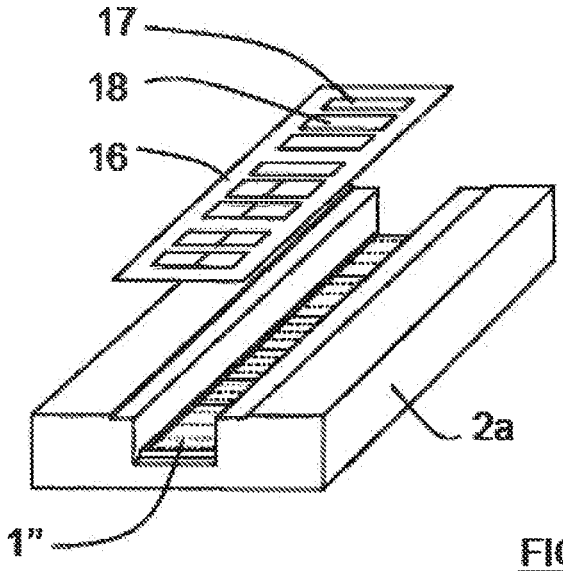
FIG. 10 shows a simplified perspective view of a first assembly step of an E-plane filter with the MEMS structure.
Figure 11:
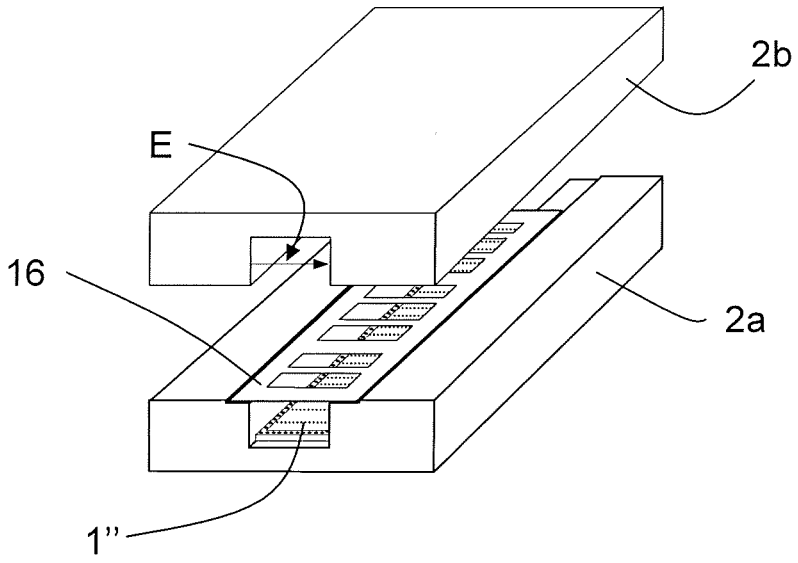
FIG. 11 shows a simplified perspective view of a second assembly step of an E-plane filter with the MEMS structure.
Figure 12:
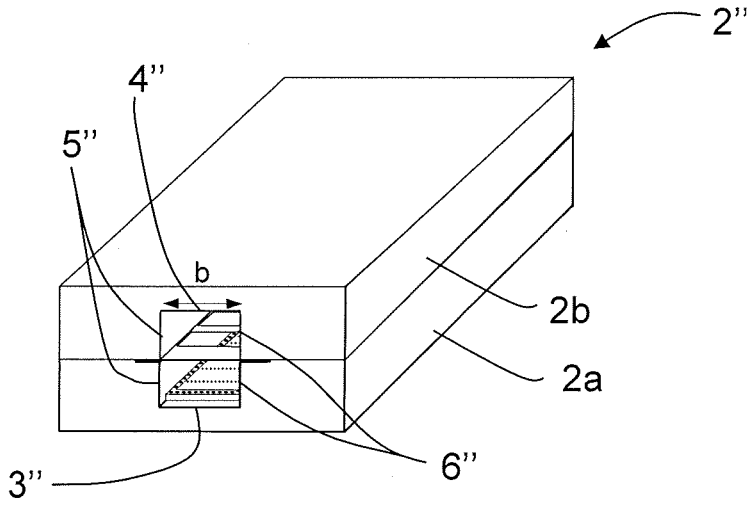
FIG. 12 shows a simplified perspective view of a third assembly step of an E-plane filter with the MEMS structure.

An E-plane filter will now be described with reference to FIG. 10, showing a simplified perspective view of a first assembly step of the E-plane filter, FIG. 11, showing a simplified perspective view of a second assembly step of the E-plane filter and FIG. 12, showing a simplified perspective view of a third assembly step of the E-plane filter.

The E-plane filter comprises a waveguide structure 2", which in turn comprises a first part 2*a* and a second part 2*b*. The first part 2*a* comprises the first inner wall 3", partly the third inner wall 5" and partly the fourth inner wall 6". The second part 2*b* comprises the second inner wall 4", partly the third inner wall 5" and partly the fourth inner wall 6". When the first part 2*a* and the second part 2*b* are mounted, as shown in FIG. 12, the third inner wall 5" and the fourth inner wall 6" are completed. Then also a metal foil 16 with a number of apertures 17, 18 is placed between the first part 2*a* and the second part 2*b*, running parallel to the first inner wall 3" and the second inner wall 4".

For reasons of clarity, only two apertures 17, 18 are denoted in FIG. 10. The number of apertures is not important to the present invention, but the forming of such a metal foil 16 is previously well-known to those skilled in the art, such that the center frequency of the filter is defined.

A MEMS structure 1" is placed on the first inner wall 3" in order to alter the distance between the first inner wall 3" and the second inner wall 4" in a corresponding manner as discussed with reference to FIG. 5 and FIG. 6.

The present invention is not limited to the examples discussed above, but may freely within the scope of the appended claims. For example, a number of MEMS structures may be stacked, allowing tuning in several steps. It is possible to use any number of MEMS structures along one short side or both short sides of a waveguide structure.

Each MEMS structure generally constitutes an electrically controllable tuning device, and at least one electrically controllable tuning device is used in accordance with the present invention.

The basic idea of the present invention lies in positioning an electrically controllable tuning device in a waveguide where the electrical field is weak and the magnetic field is strong.

Preferably, MEMS-structures based on cantilever switches are used as tuning devices, although other types of electrically controllable tuning devices are conceivable. For a rectangular waveguide, this is close to the short wall of the waveguide constituted by the first inner wall 3, 3', 3" and the second inner wall 4, 4', 4" in the Figures. In general, this means that in the examples above, the second length a exceeds the first length b.

Where MEMS structures are used, the number of rows and the general constitution of the MEMS structure are only given as an example. There may be any suitable switch arrangement constituting such a MEMS structure. There does not have to be any vias or conducting frame, but there has to be an electrical connection via the rows 9, 10, 11 of switches 12 and the surrounding third inner wall 5 and fourth inner wall 6 when the switches 12 are closed Also, a MEMS structure does not have to be mounted against any one of the first inner wall and/or second inner wall as shown in the examples above, but there may be a distance between each MEMS structure and the corresponding first inner wall and/or second inner wall. It is, however, important that there is an electrical contact between each MEMS structure and the third inner wall 5 and fourth inner wall 6, such that an electrical connection via the rows 9, 10, 11 of switches 12 and the surrounding third inner wall 5 and the fourth inner wall 6 when the switches 12 are closed.

The E-plane filter and the cavity filter are only given as examples of applications for the present invention. The present invention is applicable for any waveguide structure where tuning is desired.

The invention claimed is:

1. A tunable waveguide structure having a longitudinal extension and comprising a first inner wall having a first main surface and being electrically conducting, a second inner wall having a second main surface and being electrically conducting, a third inner wall having a third main surface and being electrically conducting, and a fourth inner wall having a fourth main surface and being electrically conducting, said first through fourth inner walls being mounted such that a rectangular cross-section is obtained for the waveguide structure where the first inner wall faces the second inner wall, the third inner wall faces the fourth inner wall, the length of the first inner wall is equal to a first length, the length of the second inner wall is equal to said first length, the length of the third inner wall is equal to a second length, and the length of the fourth inner wall is equal to said second length, wherein the tunable waveguide structure comprises at least one electrically controllable tuning device that is arranged for mounting at the first inner wall and/or the second inner wall, where the tuning device comprises a non-conducting substrate on which at least one row of Micro Electro Mechanical Systems, MEMS, cantilever switches is placed, wherein the switches are electrically openable and closable and are arranged to form an electrically conducting connection between the third inner wall and the fourth inner wall when the switches are closed, such that the switches constitute an artificial wall arranged to confine an electric field.

2. The tunable waveguide structure of claim 1, wherein the non-conducting substrate comprises a conducting frame with vias, each row of switches being arranged to form an electrically conducting connection between the third inner wall and the fourth inner wall via a conducting frame.

3. The tunable waveguide structure of claim 1, wherein the second length exceeds the first length.

4. The tunable waveguide structure of claim 1, wherein the waveguide structure is in the form of a surface-mountable wave-guide part, which is arranged to be mounted to a printed circuit board, PCB, such that a metalization on the PCB constitutes the first inner wall.

5. The tunable waveguide structure of claim 1, wherein the at least one electrically controllable tuning device is placed on the first inner wall and arranged to alter the distance between the first inner wall and the second inner wall, where the waveguide structure comprises at least one iris, each iris being in the form of a metal wall that has a main extension that runs perpendicular to each of the main surfaces of each of the inner walls, only contacting the second inner wall, the third inner wall and the fourth inner wall.

6. The tunable waveguide structure of claim 1, wherein the waveguide structure comprises a first part and a second part, where the first part comprises the first inner wall, partly the third inner wall and partly the fourth inner wall and where the second part comprises the second inner wall, partly the third inner wall and partly the fourth inner wall, where the tuning device is arranged to be placed on the first inner wall in order to alter the distance between the first inner wall and the second inner wall where a metal foil with at least two apertures is arranged to be placed between the first part and the second part, then running parallel to the first inner wall and the second inner wall.

7. A tunable waveguide structure, comprising:

a first inner wall having a main surface and being electrically conducting;

a second inner wall having a main surface and being electrically conducting, said main surface of the second inner wall facing said main surface of the first inner wall;

a third inner wall having a main surface and being electrically conducting;

a fourth inner wall having a main surface and being electrically conducting, said main surface of the fourth inner wall facing said main surface of the third inner wall; and an electrically controllable tuning device mounted on the first inner wall, the tuning device comprising a substrate on which a first set of two or more openable and closable Micro Electro Mechanical Systems (MEMS) cantilever switches is placed, said set of switches being arranged in a first row, wherein said first, second, third and fourth inner walls are arranged such that they define a rectangular cavity, the first set of switches is configured such that the rectangular cavity has a first electrical dimension when one or more switches in the first set of switches is open, the first set of switches is further configured such that the rectangular cavity has a second electrical dimension when each switch in the first set of switches is closed, and the first electrical dimension is larger than the second electrical dimension.

8. The tunable waveguide structure of claim 7, wherein the first set of switches is arranged such that the third inner wall is electrically connected to the fourth inner wall via the first set of switches when each switch in the first set of switches is closed, thereby reducing the electrical dimension of the rectangular cavity.

9. The tunable waveguide structure of claim 8, wherein the tuning device further comprises a second set of two or more openable and closable MEMS cantilever switches arranged in a second row, the second row of switches is parallel with the first row of switches, the second set of switches is arranged such that the third inner wall is electrically connected to the fourth inner wall via said second set of switches when each switch included in the second set of switches is closed.

10. The tunable waveguide structure of claim 7, further comprising a second electrically controllable tuning device mounted on the second inner wall, the second tuning device comprising a second substrate on which a second set of two or more openable and closable MEMS cantilever switches is placed, said second set of switches being arranged in a second row.

11. The tunable waveguide structure of claim 10, wherein the second set of switches is configured such that said second set of switches electrically connect the third inner wall with the fourth inner wall when each switch included in the second set of switches is closed.

12. A waveguide tuning device arranged for mounting in a waveguide structure, where the waveguide tuning device comprises a non-conducting substrate on which at least one row of Micro Electra Mechanical Systems, MEMS, cantilever switches is placed, wherein the switches are electrically openable and closable and are arranged to electrically connect a first inner wall of the waveguide structure to a second inner wall of the waveguide structure that faces the first inner wall of the waveguide structure when the switches are closed, and when the switches are closed, the switches constitute an artificial wall arranged to confine an electric field.

13. The waveguide tuning device of claim 12, wherein the waveguide structure has a cavity, and the waveguide tuning device is configured such that: i) the cavity has a first electrical dimension when the switches are open and ii) said cavity has a second electrical dimension when the switches are closed, said second dimension being smaller than the first dimension.

* * * * *